US006837020B1

(12) United States Patent
Keddell

(10) Patent No.: US 6,837,020 B1
(45) Date of Patent: Jan. 4, 2005

(54) ARCHITECTURAL TRIM PRODUCT AND METHOD OF MOUNTING

(75) Inventor: Peter M. Keddell, Apex, NC (US)

(73) Assignee: Alsco Metals Corporation, Raleigh, NC (US)

( * ) Notice: Subject to any disclaimer, the term of this patent is extended or adjusted under 35 U.S.C. 154(b) by 89 days.

(21) Appl. No.: 09/714,322

(22) Filed: Nov. 16, 2000

(51) Int. Cl.[7] ..... E04C 2/38

(52) U.S. Cl. ..... 52/745.2; 52/288.1; 52/309.8; 52/718.01; 52/717.04; 52/717.05

(58) Field of Search ..... 52/717.01, 745.15, 52/745.2, 746.1, 521, 312, 316, 309.4, 309.8, 309.9, 718.01, 718.04, 717.04, 717.05, 717.06, 745.08, 748.1, 716.1, 288.1

(56) References Cited

U.S. PATENT DOCUMENTS

| | | | | | |
|---|---|---|---|---|---|
| 4,192,113 | A | * | 3/1980 | Martin, Jr. | 52/282 |
| 4,506,486 | A | * | 3/1985 | Culpepper et al. | 52/529 |
| 4,848,045 | A | * | 7/1989 | Nichols et al. | 52/60 |
| 5,090,174 | A | * | 2/1992 | Fragale | 52/309.9 |
| 5,560,158 | A | * | 10/1996 | Norton | 52/95 |
| 5,664,376 | A | * | 9/1997 | Wilson et al. | 52/287.1 |
| 5,675,955 | A | * | 10/1997 | Champagne | 52/521 |
| 5,694,726 | A | * | 12/1997 | Wu | 52/287.1 |
| 5,729,933 | A | * | 3/1998 | Strength | 52/96 |
| 6,029,415 | A | * | 2/2000 | Culpepper et al. | 52/522 |
| 6,112,481 | A | * | 9/2000 | Schiedegger et al. | 52/211 |
| D448,865 | S | * | 10/2001 | Manning | D25/141 |
| D471,292 | S | * | 3/2003 | Barber | D25/141 |

OTHER PUBLICATIONS

Style–Mark, Inc. 1998 Architectural Accents Catalog, Publication No. 51193 (note pp. 13, 43, and 44).

* cited by examiner

*Primary Examiner*—Carl D. Friedman
*Assistant Examiner*—Naoko Stack
(74) *Attorney, Agent, or Firm*—Womble Carlyle Sandridge & Rice, PLLC

(57) ABSTRACT

An architectural trim product formed of a metal sheet material that is bent to a selected profile shape by the interaction of mating contoured die surfaces. The product has a first end that engages first edge of a mounting member and a second end that engages the opposite edge of the mounting member. The second end of the trim product includes a bent edge that grips the mounting member to securely hold thereto. The fasteners used to affix the mounting member to the building structure are subsequently covered so that no trim product fasteners remain visible.

4 Claims, 7 Drawing Sheets

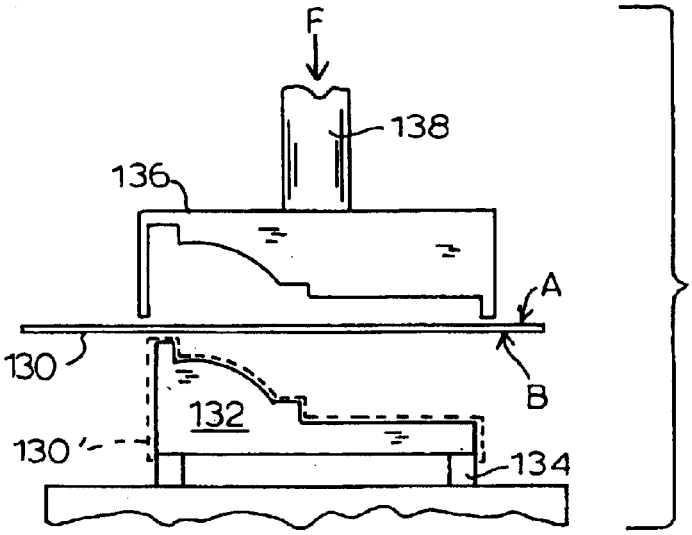
FIG. 8
FIG. 9
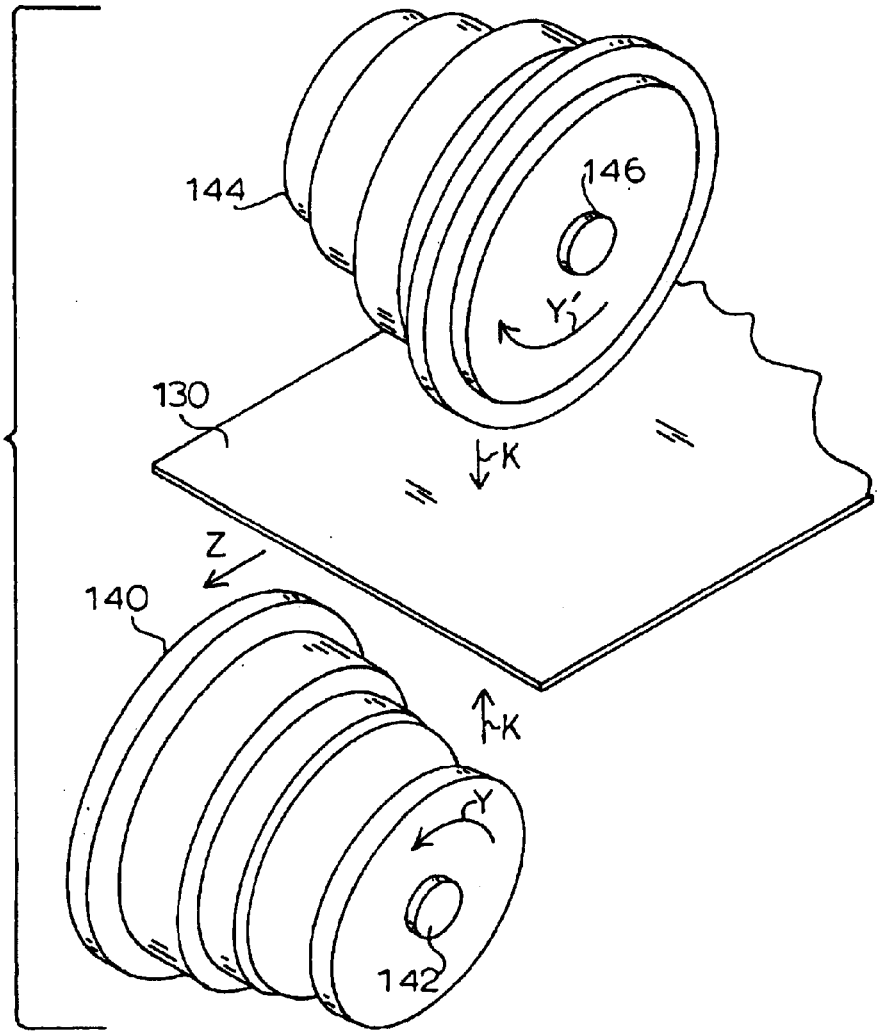

ARCHITECTURAL TRIM PRODUCT AND METHOD OF MOUNTING

FIELD OF THE INVENTION

The present invention relates to the field of building construction materials, and more particularly to building architectural trim products.

BACKGROUND OF THE INVENTION

The architectural distinctiveness of a house or other building is often attributable to the trim that provides a finishing touch to an otherwise common shape. Trim distinctiveness has, through the years, evolved from Greek, Roman, Gothic, and Victorian to contemporary and modernistic. Each style has various characteristic details and shapes that sets it apart from the others.

Parallel changes have come about through the development of building materials, especially those materials that form the visible surface of a house or building. Common exterior surface materials in use today are wood, brick, vinyl, and aluminum. Vinyl and aluminum have the advantage of being supplied from the factory with its final color applied, and need no more than minimum maintenance. With each of these exterior surface materials, the trim portions of the building, e.g., the crosshead piece over a door or window, the fascia below the roofline, the transition frieze, or molding, between a wall and ceiling, are almost always made of wood. The reason for wood being used for this purpose is that wood can be efficiently formed into attractive shapes that are distinctive to a particular style. Forming similar shapes of plastic requires complex molds, and shapes of metal or concrete have traditionally been heavy. Even where the exterior siding of a building is made of vinyl or aluminum, modem siding materials that are mass produced with their surface colors applied at the factory, the trim has generally been made of wood. However, wood has the drawback of requiring periodic maintenance in the form of scraping and painting to prevent degradation.

One known exception is a line of architectural trim products made of plastic resin from Style-Mark, Inc. of Archbold, Ohio. These known plastic trim products require substantial molding investment and capacity to produce, and involve either a substantial inventory or a significant delivery delay to obtain. In addition, in order to keep inventory within reason, these trim products are available in white only; if another color is desired, the parts must be painted at the construction site.

A process and apparatus exists for forming factory painted aluminum sheet into rain gutters. The aluminum is supplied in roll form and is drawn as a sheet through a mechanism having complementary convex and concave rollers to form the profile gutter shape. Forming aluminum rolled sheet into gutters at the site of installation has the advantage of permitting a seamless, continuous length of gutter to be installed across the entire edge of a house's roof, without the need to transport long gutter sections, e.g. 10 meter (39 feet), over the roads to the building site.

While forming aluminum sheet into gutters is known, the objective has been to achieve long, continuous sections, as described above. Furthermore, gutters are typically of a simple and functional cross sectional contour with an upwardly open channel. In the design of architectural trim products, a degree of flexibility is necessary since the style of the building will dictate the style and the width of the trim.

Therefore, it is an object of the present invention to provide an architectural trim product that can be economically produced in a variety of shapes and styles.

It is another object of the present invention to provide an architectural trim product that can be produced in a variety of colors without the need for painting at the construction site.

It is a further object of the present invention to provide an architectural trim product that does not require periodic maintenance.

These and other objects of the present invention will become apparent through the disclosure of the invention to follow.

SUMMARY OF THE INVENTION

The present invention provides an architectural trim product fabricated of sections formed out of aluminum sheet material. The sections have a cross sectional profile shape that includes curved portions and right angle bends. The sections are optionally used as a fascia, a frieze in lengths matching the length of a wall-to-soffit joint, crosshead trim over a window or door or other trim uses. In the crosshead application, the horizontal section piece is mitered at each end and the ends are each closed with a short piece of similar miter-cut section, giving the appearance of a three-dimensional solid. An attaching bolster, or stiffening block, is formed in a shape to fit behind the contour of the trim section to support it to a wall while minimizing the tendency of the aluminum to bend. In all forms, the method of mounting the trim product of the invention to the building structure provides secure attachment with no visible nails, screws, or adhesive.

The sections of architectural trim are made from aluminum sheet pieces that have been cut to length and then bent. The curves are formed first by pressing the sheet between two shaped components, for example pipe segments. After forming the curves, the right-angle bends are made on a conventional brake, or the like. An alternate forming process uses a set of matching rollers to form the aluminum sheet into a contour-shaped trim piece.

BRIEF DESCRIPTION OF THE DRAWINGS

In order for the invention to become more clearly understood it will be disclosed in greater detail with reference to the accompanying drawings, in which:

FIG. 8 is an end elevation view of a press die set having curved and angular portions for creating curved and angular contour portions in a sheet of bendable materials.

FIG. 9 is a perspective view of a pair of engageable die rollers having surfaces formed with curved and angular portions for creating curved and angular contour portions in a sheet of bendable material.

DESCRIPTION OF THE PREFERRED EMBODIMENT

The architectural trim product of the present invention is an economical and versatile component for enhancing the appearance of the interior or exterior of a building. The trim product can be formed to emulate the appearance of most of the building trim products that are currently available in wood or molded plastic resin, in an efficient and attractive way. Examples of types of trim products to which the present invention pertains include, but are not limited to, crosshead trim over windows and doors, friezes between an exterior wall and an adjacent soffit, cove molding between an interior wall and a ceiling, and fireplace mantles. In all embodiments of the invention, the component that will remain in view covers the wall-mounting component and any fasteners.

Figure 1:
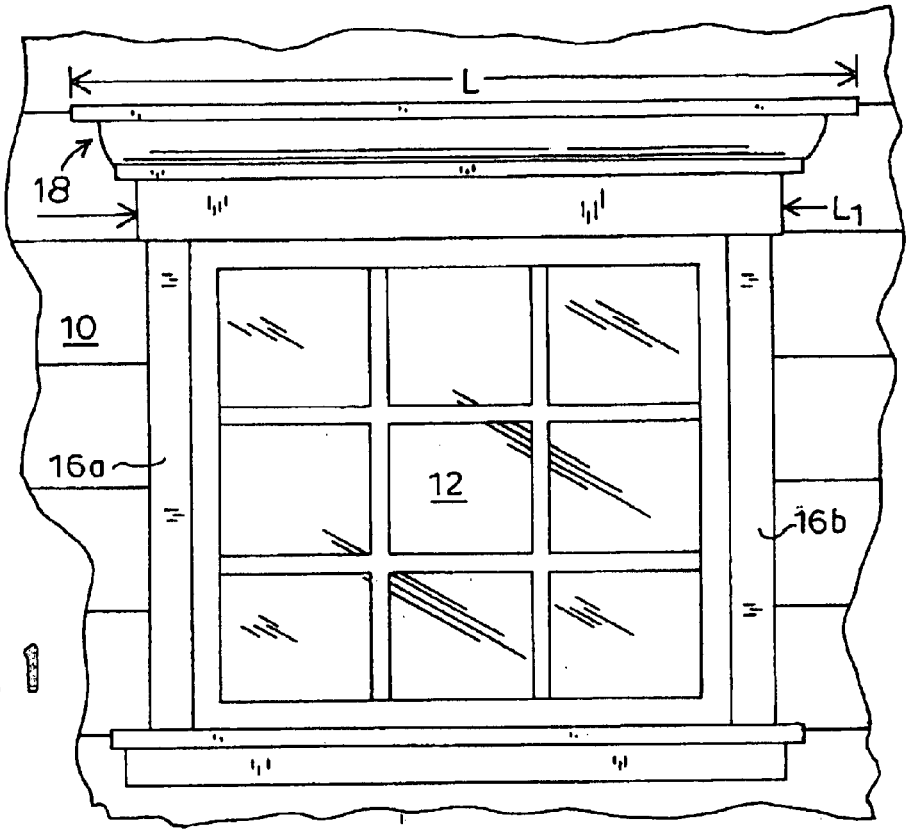
FIG. 1 is a front elevation view of a building wall having a window over which a crosshead architectural trim product according to the invention is mounted.

Referring now to FIG. 1, a wall of building 10 is illustrated with typical window 12 located therein. Window 12 may be of the type having a plurality of individual frames (as shown) or of the type with a single frame for each of its upper and lower sections. A first side trim 16*a* is mounted in vertical orientation on the left side of window 12 and a second side trim 16*b* is mounted similarly on the right side thereof. Side trims 16*a* and 16*b* preferably are formed of a bendable sheet material. A crosshead 18 is mounted above window 12 and extends laterally to slightly overlap each of side trims 16*a* and 16*b* for architectural interest. The particular shape of crosshead 18 as illustrated is stepped from its bottom surface (as shown), of length $L_1$, to its top surface of length L so that its top surface overhangs side trims 16*a* and 16*b* by a greater amount than does its bottom surface. Each end of crosshead 18 is closed by a short piece of the same profile shape of which the central portion of crosshead 18 is made with the central portion and the end portions cut at a complementary shape with their mutual joint sealed with a pliant material, for example caulking compound.

Figure 2:
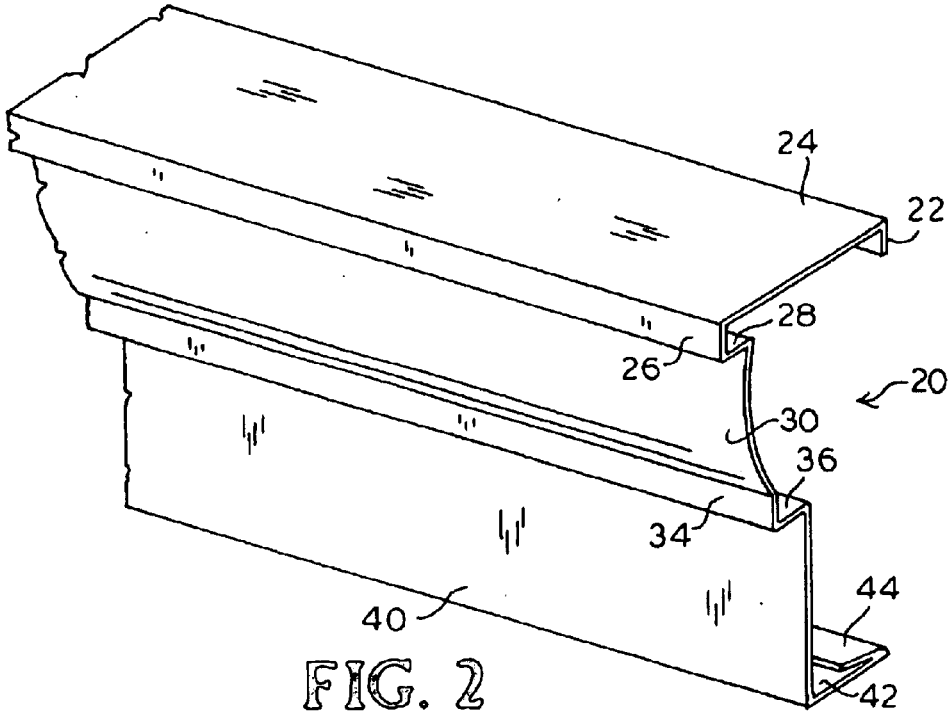
FIG. 2 is a perspective view of a section of formed sheet material for making an architectural trim product of the invention.

FIG. 2 illustrates, in perspective view, a length of formed sheet material 20 that has been bent to create a desired profile for being assembled to make crosshead 18 as described above. Formed sheet 20 is formed by making a number of curved and square bends in an elongate sheet of material of the type that is able to retain a shape to which it is bent. A sheet material that has been found to be satisfactory is aluminum sheet of 0.56 mm (0.022 inch) thickness. Such aluminum sheet material is available with one surface painted during the manufacturing process, and is available from a variety of suppliers, for example, Aluminum Corporation of America. Alternate materials that provides the requisite characteristics of retaining a bent shape are, for example, copper sheet and galvanized steel sheet. Formed sheet material 20 comprises a series of linear bends oriented parallel to the elongate linear edges of sheet 20, including vertically oriented rear lip 22, horizontally oriented top panel 24, vertically oriented top face 26, horizontal return 28, curved portion 30, vertically oriented middle face 34, horizontally oriented middle return 36, vertically oriented skirt 40, horizontally oriented bottom return 42, and angularly oriented grip 44. As will be apparent to those skilled in the trade, formed sheet material 20 may incorporate various arrangements of right angle, curved, and angled bends. Any curved portions formed may be either concave or convex and either circular or another form of curve, e.g. parabolic. Additionally, more than one curved portion may be formed to achieve a different appearance.

Figure 3:
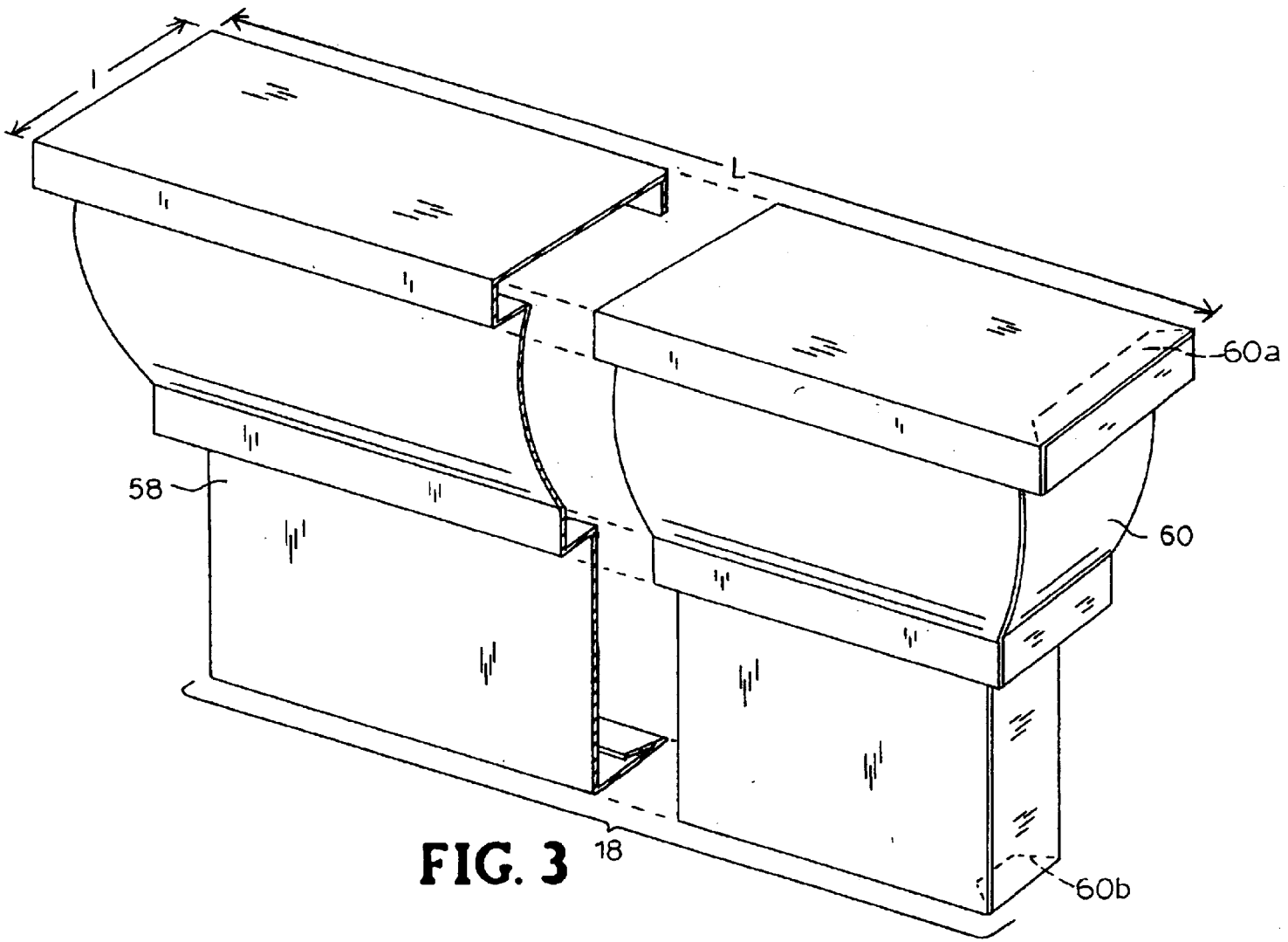
FIG. 3 is a perspective view of the crosshead trim product according to FIG. 1.

Referring now to FIG. 3, crosshead 18 is shown in perspective view including front panel 58 and end cap 60. Length L of crosshead 18 is substantially greater than width 1 thereof. Front panel 58 and end cap 60 are each cut from a length of formed sheet material 20 (see FIG. 2). Front panel 58 and end cap 60 are cut along their mating edges at complementary miter angles to be assembled to each other and form a three-dimensional component. For mounting crosshead 18 over window 12, as illustrated in FIG. 1, the opposite end of front panel 58 and a second end cap (not shown) are similarly prepared and assembled. Upper tab 60*a* and lower tab 60*b* are configured to securely engage the mating end of front panel 58. When end cap 60 is assembled to front panel 58, a weather resistant sealant, e.g. silicone caulk, is applied to the rear of the mating edge, preferably in a color to match the exposed surfaces of crosshead 18.

Figure 4:
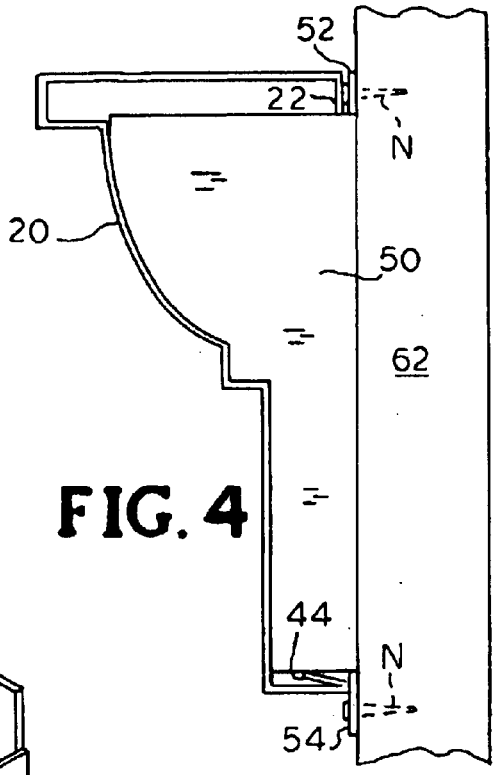
FIG. 4 is a side elevation view of the architectural trim product according to FIG. 3, further showing a bolster support piece therewithin.
Figure 4A:
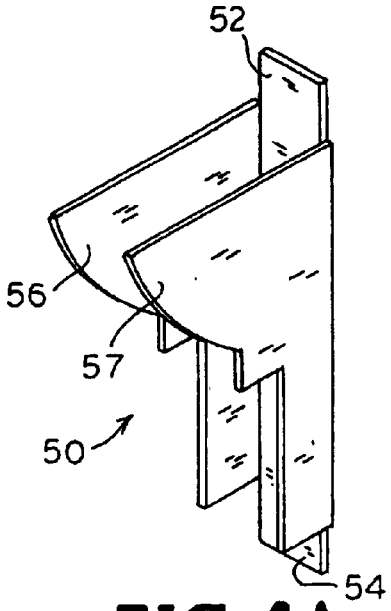
FIG. 4A is a perspective view of the bolster support piece of FIG. 4.
Figure 4B:
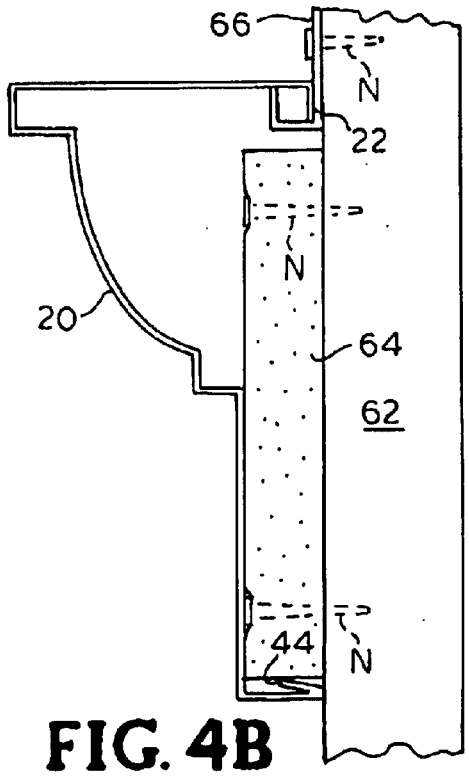
FIG. 4B is a side elevation view of the architectural trim product according to FIG. 3, further showing a J-hook and a block as mounting pieces therewithin.

FIGS. 4 and 4B show side elevation views of alternate means of mounting a length of formed sheet 20 to a building wall 62. FIG. 4 shows bolster 50 fastened to wall 62 by multiple fasteners N, such as nails, screws, or adhesive. Bolster 50 is preferably formed in a profile shape that is established to substantially follow the interior profile of formed sheet material 20. Bolster 50, in the preferred embodiment, is made by cutting a sheet of bendable material, e.g. aluminum, to an appropriate profile shape. Preferably, the profile shape of bolster 50 is cut in two mirror image flaps 56 and 57 that are separated by a flat area extending from extended top tab 52 to extended bottom tab 54, as shown in perspective in FIG. 4A. Bolster 50 serves to mount formed sheet 20 to wall 62 and also to minimize bending of formed sheet 20 if it is hit by an object. Bolster 50 is secured to wall 62 with a fastener N through top tab 52 and a second fastener N through bottom tab 54. Top fastener N is hidden by rear lip 22. Second fastener N through bottom tab 54 will be subsequently hidden by exterior siding panels (not shown) when they are assembled to wall 62. Thus, the finished trim product will have no visible means of attachment to wall 62. The parallel profile provision of two flaps 56 and 57 enhances the resistance of Grip 44 (see FIG. 4) maximizes the security of mounting formed sheet 20 to bolster 50 through pressure and sharp edge engagement, with a sharp edge (not shown) existing at the bottom of rear lip 22 to engage the top portion of bolster 50 and a sharp edge (not shown) at the end of grip 44 to engage the bottom portion of bolster 50.

Referring now to FIG. 4B, formed sheet 20 is shown mounted to wall 62 by means of block 64 and J-hook 66. Block 64 is a substantially elongate member having a substantially rectangular cross section, for example wood or plastic foam. J-hook 66 is formed of a strip of bendable material, e.g., aluminum, that has been bent in the general shape of a "J" so that when the upper straight portion thereof is fastened to wall 62 by fastening means N, for example nails or screws, the lower portion of the "J" is facing upwards. Block 64 is fastened to wall 62 by fastening means N at a height so that when rear lip 22 of formed sheet 20 is placed in the lower portion of J-hook 66, and the bottom of formed sheet 20 is brought toward wall 62, grip 44 grippingly engages the bottom surface of block 64 to secure formed sheet 20 in place.

Figure 5:
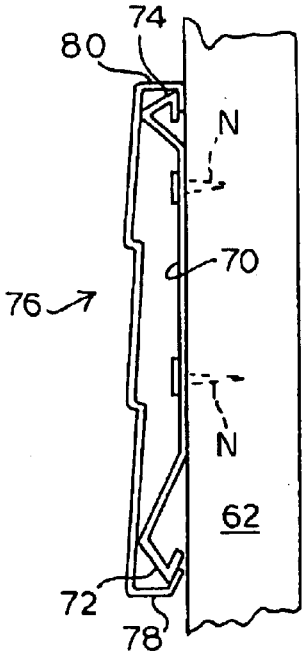
FIG. 5 is a side elevation view of a second embodiment of the invention as mounted to a building wall with a mounting clip.

Referring now to FIG. 5, a third embodiment of the invention is illustrated in side elevation view. A mounting clip 70 is formed with a substantially planar central portion, a bottom lip 72, and a top lip 74. The central planar portion of mounting clip 70 is affixed to wall 62 by any convenient means, e.g. fasteners N, and bottom lip 72 and top lip 74 are not anchored. Bottom lip 72 is formed with its lowermost part spaced from wall 62. Top lip 74 is formed with its uppermost part slightly spaced from wall 62 with an angularly oriented planar portion leading toward its uppermost part.

Continuing with FIG. 5, face trim 76 is formed to mount onto mounting clip 70. Face trim 76 has bottom hook 78, formed to engage bottom lip 72 of mounting clip 70. Face trim 76 also has top hook 80, formed to engage top lip 74 of mounting clip 70.

Figure 5A:
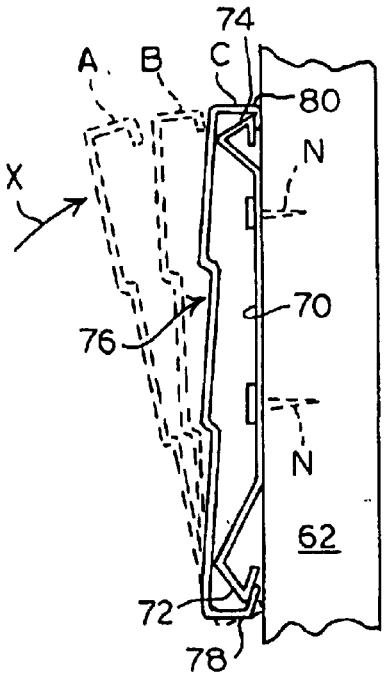
FIG. 5A is a side elevation view of the embodiment of FIG. 5 showing the steps involved in mounting the trim product to the mounting clip.

The assembly of face trim 76 to mounting clip 70 is illustrated in sequential steps in FIG. 5A. After bottom hook 78 of face trim 76 has been placed in engagement with bottom lip 72 of mounting clip 70 (see FIG. 5), top hook 80 is placed against the angled portion of top lip 74 as seen as dashed line A. pressure is exerted against top hook 80 in the general direction indicated by arrow X, causing top hook 80 to bend upwardly relative to the body of face trim 76 (see FIG. 5A), moving from position A (dashed lines) to position B (dashed lines). As top hook 80 approaches the uppermost end of top lip 74, its extreme end snaps over and into place between top lip 74 and wall 62 as indicated at position C (solid lines). Once in this mounted position, depending on the length of top hook 80 that enters behind top lip 74, removal of face trim 76 is difficult, if not impossible, without substantial distortion.

Figure 5B:
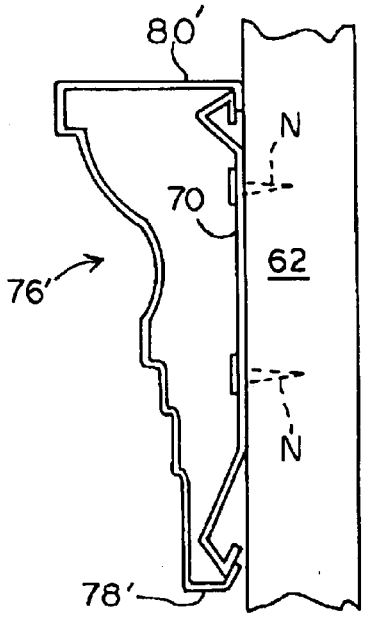
FIG. 5B is a side elevation view of an alternate shape trim product of the embodiment of FIG. 5.

Referring now to FIG. 5B, a further profile shape of this second embodiment of the invention is shown. In this profile shape, mounting clip 70 is formed similarly to that discussed and shown above, but face trim 76' has a more exaggerated profile. Top hook 80' and bottom hook 78' securely hold face trim 76' to mounting clip 70. In this manner, differing architectural styles can be accommodated using the mounting principles described above.

The face trim products shown in FIGS. 5, 5A, and 5B and described above are adaptable for a variety of interior and exterior construction components. In addition to the exterior components of crosshead, fascia, and frieze described in relation to the first embodiments of the present invention, this second embodiment is useful as crown molding, window or door casings, baseboards, and mantle pieces.

Figure 6:
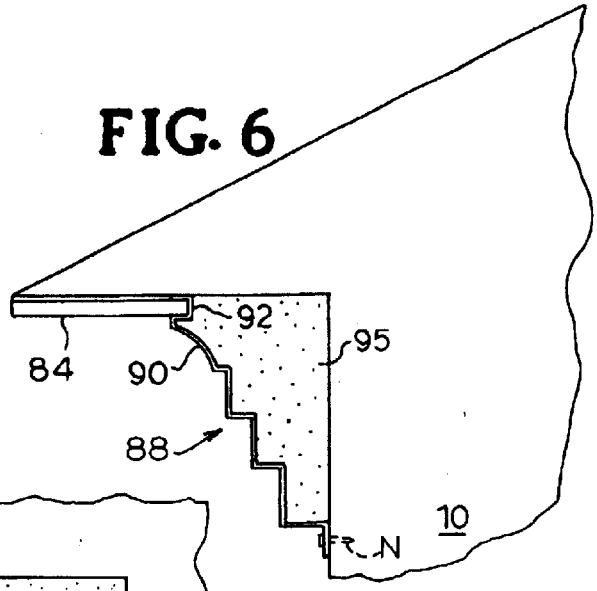
FIG. 6 is a side elevation view of a portion of a building to which a frieze with a concave curve portion according to the invention has been mounted.

As briefly described above, a frieze, being a building component that is installed as a transitional trim between a vertical wall and a ceiling or soffit, is typical of a further embodiment of the present invention. A side elevation view of a frieze 88, mounted between an exterior wall of building 10 and a soffit 84, is illustrated in FIG. 6. Frieze 88 has single concave curve section 90 and a number of alternating inwardly and outwardly oriented right angle bends. Anchor 92 is formed at an upper end of frieze 88 and configured to engage an adjacent edge of soffit 84. The lower edge of frieze 88 is typically secured to building wall 10 by fastening means N prior to the application of exterior siding. Stiffening block 95 is made to substantially conform to the contour of and provide reinforcement for frieze 88. Stiffening block 95 is preferably formed of foamed plastic resin.

Figure 6C:
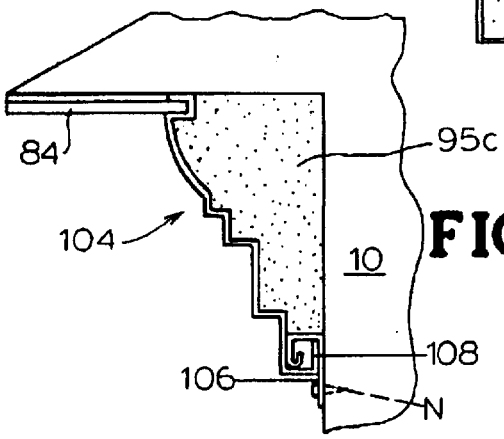
FIG. 6C is a side elevation view of a portion of a building to which a frieze with a convex curve according to the invention has been mounted by means of a J-hook.
Figure 6A:
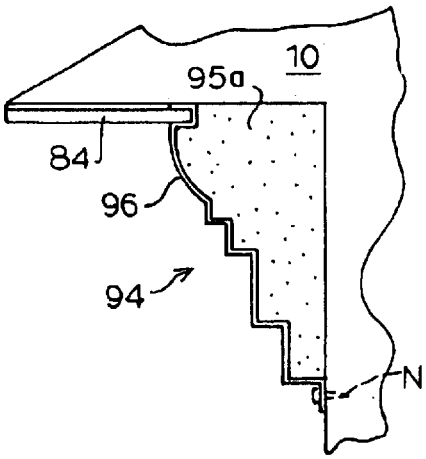
FIG. 6A is a side elevation view of a portion of a building to which a frieze with a convex curve according to the invention has been mounted.

FIG. 6A illustrates a side elevation view of a frieze 94 which is a variation of the frieze contour shown in FIG. 6 and described above. Frieze 94 comprises a convex curve section 96, as differing, from concave curve section 90 described above. Stiffening block 95*a* is similar to stiffening block 95 described above.

Figure 6B:
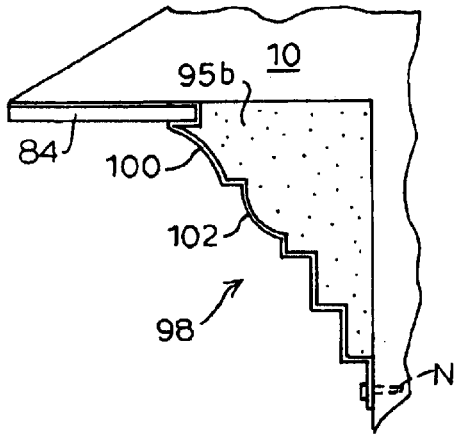
FIG. 6B is a side elevation view of a portion of a building to which a frieze with concave and convex curve portions according to the invention has been mounted.

FIG. 6B illustrates a side elevation view of a frieze 98 that incorporates concave curve section 100 and convex curve section 102. Additional variations, for example, curved sections positioned at the center or the lower end of the frieze, multiple concave or multiple convex sections, and parabolic or elliptical curves are also obtainable. Stiffening block 95*b* is similar to stiffening block 95 described above.

FIG. 6C depicts frieze 104 which is similar in contour to frieze 94 of FIG. 6A. Frieze 104 is formed with an anchor portion for engagement with an inside edge of soffit 84 as described above. The visible face area of frieze 104 may be formed with a variety of convex or concave curves and one or more square bends. Stiffening block 95*c* is positioned between frieze 104 and the structure of house 10 to reduce the chance of frieze 104 being dented or bent after installation. Frieze 104 terminates with an upwardly facing edge 108 that engages J-hook 106, assembled to house 10 in inverted orientation by fastener N. Fastener 10 may be screws, nails, or adhesive, e.g. silicone caulk material.

Figure 7:
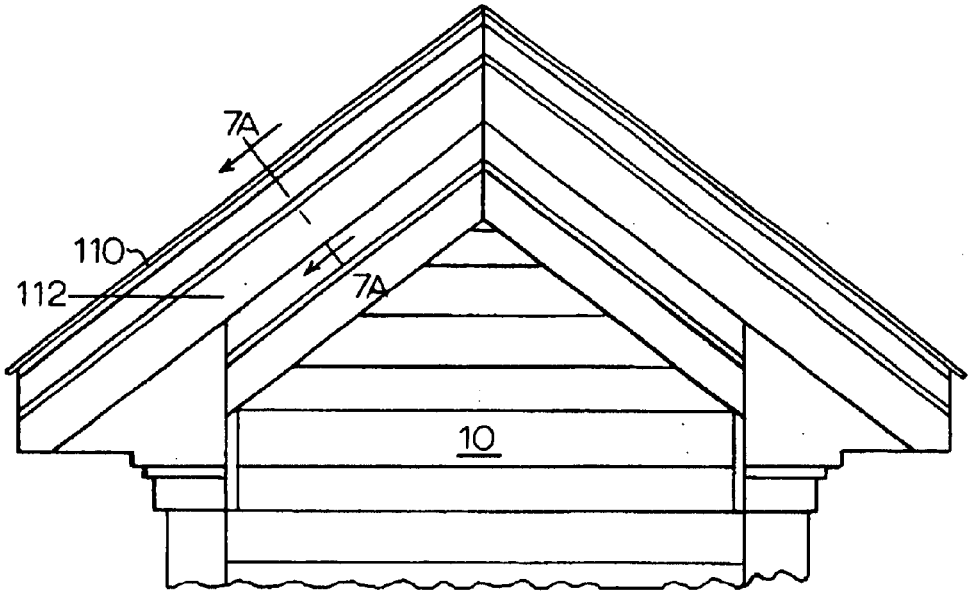
FIG. 7 is a front elevation view of a portion of a building roofline to which a fascia trim product according to the invention is mounted.

Referring now to FIG. 7, a portion of a roofline of a building 10 is shown in front elevation view. Fascia 112 is positioned at the forward surface of the eave with roofing material 110 above.

Figure 7A:
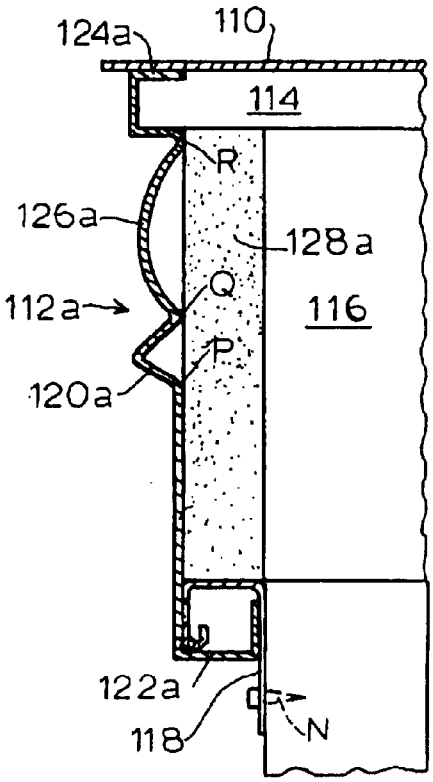
FIG. 7A is an enlarged cross sectional view taken in the direction of line 7A—7A of FIG. 7 and depicting a fascia of a first contour.

FIG. 7A is a cross sectional view of fascia taken in the direction of line 7A—7A of FIG. 7 configured with a first contour. Block 128*a* is mounted to the side of rafter 116 by adhesive or other fastener means. J-hook 118 is mounted in inverted orientation beneath block 128*a*. Fascia 112*a* is then placed with its lower end 122*a* engaging J-hook 118 and its upper edge 124*a* engaging roof sheathing 114. Upper edge 124*a* may optionally be affixed to sheathing 114 by means of an adhesive such as, for example, silicone caulk material. Exterior roofing material, e.g. shingles, 110 is applied last. Fascia 112*a* is configured to mount with edges P, Q, and R in contact with block 128*a*, thus affording sufficient stiffening to avoid bending or minor denting.

Figure 7B:
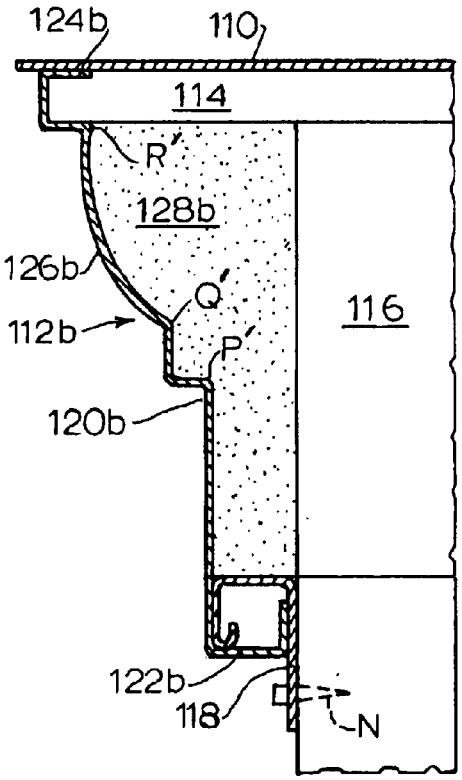
FIG. 7B is an enlarged cross sectional view taken in the direction of line 7A—7A and depicting a fascia of a second contour.

FIG. 7B provides a cross sectional view of a fascia 112*b* that differs in contour and means of support from fascia 112*a* of FIG. 7A. Fascia 112*b* is configured to extend further outwardly from rafter 116 at its top portion than at its bottom portion. To accommodate this greater extension of fascia 112*b*, roof sheathing 114 is mounted to protrude a greater distance beyond rafter 116 than occurs in the illustration of FIG. 7A. Stiffening block 128*b* substantially conforms to the interior dimensions of fascia 112*b* and is adhesively or otherwise mounted to rafter 116. Fascia 112*b* is mounted with its lower edge engaging inverted J-hook 118 and its upper edge 124*b* engaging and adhered to roof sheathing 114, thus supporting corners P', Q', and R' and the surfaces between. As with prior described trim products, any nails, screws, or adhesive used for mounting the trim product or a supporting J-hook or other component are positioned to be totally hidden when the siding panels or other exterior parts are installed. In this way, a finished installation without visible fasteners is achieved.

Referring now to FIG. 8, a side elevation view is shown of a first embodiment set of forming dies 132, 136 according to the present invention. The solid line drawing shows forming dies 132 and 136 prior to closure with sheet 130 of bendable material in position with surface A painted and surface B unpainted. The dashed line drawing shows formed sheet 130' after closure of forming dies 132, 136. The lower part of the die set consists of lower die 132, having a selected contour, for example including one or more curved sections and one or more angular sections, and is substantially elongate in a direction perpendicular to the plane of the drawing. Columns 134 support base 132. Upper die 136 is made in a matching contour to the contour of base 132. Form 136 is supported above base 132 by ram 138. Rear lip 22, bottom return 42, and grip 44 (see FIG. 2) are formed in a subsequent bending operation.

In operation, bendable sheet 130 is placed substantially flat on lower die 132 and a downwardly directed force F is applied to upper die 136 through ram 128 to bend sheet 130 to become, after forming, sheet 130', shown in dashed lines. According to the desired configuration of sheet 130', different combinations and relationships of curved and angular portions create differing architectural effects.

Referring now to FIG. 9, an alternate device employing base die roller 140 and form die roller 144 is disclosed for the continuous formation of contours in a sheet 130 of bendable material. A cross sectional view through base die roller 140 and form die roller 144 is substantially equal to the elevation view of forming dies 132, 136 shown in FIG. 8. By forming a set of dies as rollers, longer continuous lengths of formed sheet are possible than with a fixed length set of opposed dies. Base die roller 140 mounts on shaft 142 and is driven in the rotational direction indicated by arrow Y. Form die roller 144 mounts on shaft 146 and is driven in the rotational direction indicated by arrow Y'. Both base die roller 140 and form die roller 144 have matching areas of curvature and a number of alternating inwardly and outwardly oriented right angle bends to form a sheet of bendable material 130 similarly when die rollers 140 and 144 are brought together in the direction of arrows K and rotated and sheet 106 moves in the direction of arrow Z. As will be readily understood, the result will be similar whether base die roller 140 moves up or form die roller 144 moves down, or both move toward each other. Depending on the length of sheet material supply and the length of formed sheet required, transverse cuts are made at selected intervals along the formed sheet. As noted above in respect to forming dies 132 and 136 of FIG. 8, rear lip 22, bottom return 42, and grip 44 (see FIG. 2) are formed in a separate bending operation.

In each of the disclosed embodiments of the present invention, a sheet of material is bent to obtain a selected cross sectional profile between linear edges thereof. The architectural trim products thus formed are mounted to a building with both of the linear edges in contact with a building surface and with all fasteners, e.g. nails or screws, positioned to be subsequently masked by other trim components or siding. Thus, no fasteners of the trim products of the invention are visible in the finished building.

The above detailed description of a preferred embodiment of the invention sets forth the best mode contemplated by the inventor for carrying out the invention at the time of filing this application and is provided by way of example and not as a limitation. Accordingly, various modifications and variations obvious to a person of ordinary skill in the art to which it pertains are deemed to hie within the scope and spirit of the invention as set forth in the following claims.

What is claimed is:

1. A method of forming and applying an elongated horizontal transitional trim product comprising:

a) forming an elongated molded, horizontally-positioned stiffening block, comprising:
   i) a flat, vertical back surface;
   ii) a flat, horizontal top surface;
   iii) a flat, horizontal bottom surface; and
   iv) a front surface extending between an outer edge proximate said top surface and an outer edge proximate said bottom surface, and providing in its cross-sectional profile a plurality of interconnected, continuous surfaces, including both flat and curved, vertical and horizontal surfaces;

b) fixedly securing said molded horizontally-positioned stiffening block directly to a flat, vertical surface of said building;

c) forming an elongated, horizontal deformable metallic sheet terminating in respective upper and lower end sections located above and below a central section and characterized by said central section providing, in its cross-sectional profile, a plurality of interconnected, continuous surfaces, which mate and snugly fit with the cross-sectional profile of said stiffening block, said central, upper, and lower end sections bring shaped so as to enable said sheet, prior to installation of other support means, to be installed on, supported by, and closely fitted to said stiffening block; and d) mounting said sheet onto said stiffening block by utilizing the shape of said central upper, and lower end sections of said sheet to support and maintain said sheet on said stiffening block prior to installation of other support means.

2. The method of claim 1, wherein said upper-end section of said sheet is formed in a U-shape adapted to receive and snugly fit an exposed edge of a horizontal member secured to said building outwardly of said trim product and including the step of engaging a said horizontal member with said U-shaped upper-end section.

3. The method of claim 1, wherein said sheet of deformable metallic material is chosen from aluminum, copper and steel.

4. The method of claim 1, wherein said molded stiffening block is made of foamed plastic resin.

* * * * *